United States Patent [19]

Morrison

[11] 4,018,035

[45] Apr. 19, 1977

[54] CINCH WINCH FOR SADDLING A HORSE

[76] Inventor: Neolan V. Morrison, 326 Addison St., Palo Alto, Calif. 94301

[22] Filed: Mar. 12, 1976

[21] Appl. No.: 666,159

[52] U.S. Cl. ..... 54/23; 254/164; 254/186 HC

[51] Int. Cl.[2] ..... B68C 1/00

[58] Field of Search ..... 54/23; 242/107.4, 84.5, 242/96; 278/129, 130; 24/68, 164; 254/79, 163, 164, 186 HC; 81/177 A, 177 E, 177 G, 177.9, 60, 61; 74/577, 578, 547; 19/103

[56] References Cited

UNITED STATES PATENTS

| | | | |
|---|---|---|---|
| 3,281,120 | 10/1966 | Richardson | 254/186 HC |
| 3,536,299 | 10/1970 | McCloud et al. | 74/547 |
| 3,861,126 | 1/1975 | Morrison | 54/23 |

*Primary Examiner*—Louis G. Mancene
*Assistant Examiner*—Peter K. Skiff
*Attorney, Agent, or Firm*—Alfons Puishes

[57] ABSTRACT

A device for facilitating the saddling of a horse by making easier and more flexible the fastening of the strap between the rigging ring on the saddle and the cinch strap under the belly of the horse, is further improved by the addition of a novel wrench device. The rotary winch or roller which effects the tightening of the strap takes the form of a hollow cylinder and includes in its interior a novel cylindrical ratchet with an engaging pawl and a retractable, telescoping handle permanently positioned therein to provide ready and convenient access for operation, freedom from interference, and avoidance of loss or misplacement of the handle.

7 Claims, 9 Drawing Figures

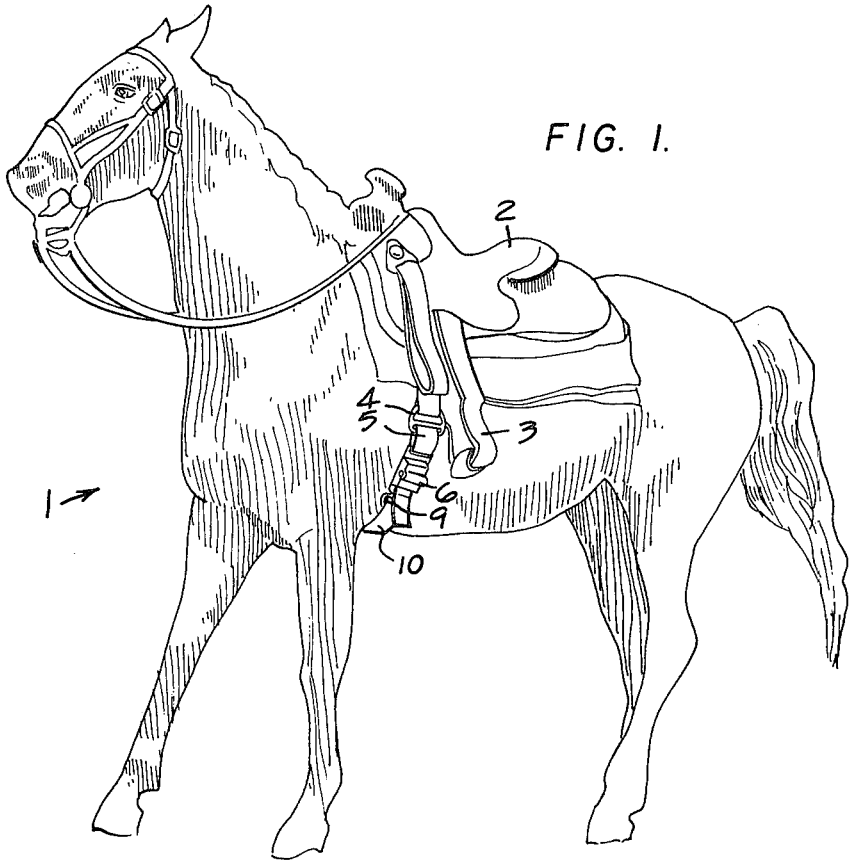
FIG. 1.
FIG. 2.
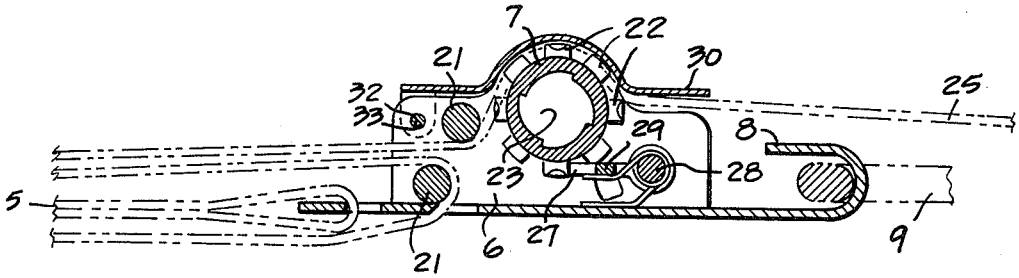

CINCH WINCH FOR SADDLING A HORSE

BACKGROUND OF THE INVENTION

In my U.S. Pat. No. 3,861,126on a CINCH WINCH FOR SADDLING A HORSE, I set forth the long standing problems associated with saddling a horse which have existed for generations. These concern the fastening of the saddle to the horse through a cinch strap under the horse's belly by means of a latigo strap which was passed through a saddle ring and the cinch ring and then formed in a latigo knot. The problems of overcoming the cumbersomeness of tieing this knot, the lack of flexibility, and difficulty of adjusting the knot and consequently the tightness of the saddle on the horse, were overcome by the invention covered by the above patent.

There remained one problem, however, in connection with the operation of my previous device. The wrench means used to rotate my winch was of necessity removable since it would not be practicable to have it permanently in position against the body of the horse or the leg of the rider. In my previous invention I disclosed that this may be kept in the saddle bag when not in use.

Such a removable or portable wrench had the disadvantage of being subject to loss or misplacement and of not being readily available for operation particularly when the rider was mounted upon the horse. For the greater success of my previous invention it was necessary to provide a wrench or tightening means which would not only be permanently attached to or fixed upon my cinch winch device but would also be free from interference with the horse or rider when the device was not being used for adjusting the strap and saddle.

I was not aware of any existing wrench or tightening device which could perform these combined functions until my invention of the device described herein.

SUMMARY OF THE INVENTION

I have discovered that the device of my invention described herein maybe combined with may invention covered by my U.S. Pat. No. 3,861,126to overcome the problems set forth above in connection with an improved method of saddling a horse.

As before, I provide a housing in which is located a roller or rotating winch, the housing being adapted for positioning against the side of the horse's body. On the lower end of the housing I provide a hook which engages the conventional cinch ring which in turn is permanently connected to the strap passing under the horse's belly. At the upper end of my housing I provide means for permanently fastening one end of a strap. I then pass my strap through a more or less conventional saddle ring located on the saddle itself, double it back and then pass it back down to the housing again where it is disposed to engage my winch or roller. The strap is equipped with suitably spaced holes along its length which are in turn disposed to engage protruding teeth in the roller, means being provided to guide the strap over the roller to insure positive engagement between the strap and the roller teeth. A novel dog or latch arrangement is positioned to engage the teeth and hold them in any given position as desired. A release mechanism is positioned in the housing to release my dog or latch at any time it is so desired and permit adjusting the strap and consequently the entire saddle assembly in a tighter or looser relationship with the horse as is desired.

My combination makes the saddling assembly stronger and more secure. It may be tightened and fastened while the person is mounted and is especially convenient for young riders, as well as the old and handicapped, to tighten and maintain a desired tension adding greatly to the safety of the saddle. It likewise eliminates the bulky latigo knot under the stirrup leather and is easy to change from one saddle to another. Because of its simplicity it will outlast several latigos, making it cheaper in the long run.

Of particular advantage is the feature which permits changing the amount of tension on the horse while riding, since it is well known to experienced riders that the horse may expand or contract its muscles depending on the riding, strain, temperature, and so on, all of which may be compensated for while the rider is mounted and without dismounting and retying the latigo knot.

I now provide a novel telescoping and retractable wrench having a universal joint and equipped with a pawl which engages the novel ratchet forming a part of the interior of my hollow cylindrical winch. The wrench which is normally housed within the winch may be withdrawn and used to turn the winch as needed to adjust the saddle and then slid back into its housing, its special construction preventing its complete removal or disassociation with the rest of the device and consequently loss or misplacement at any time.

DESCRIPTION OF THE DRAWINGS

FIG. 1 shows a horse and saddle with my device in position and its relationship to the former.

FIG. 2 is cross-section through my device along the lines 2—2 of FIG. 3 showing the internal arrangement of my mechanism.

FIG. 3 is a perspective showing the general assembly of my invention with component parts and a partial cut-away through the winch.

DESCRIPTION OF A PREFERRED EMBODIMENT

Figure 3A:
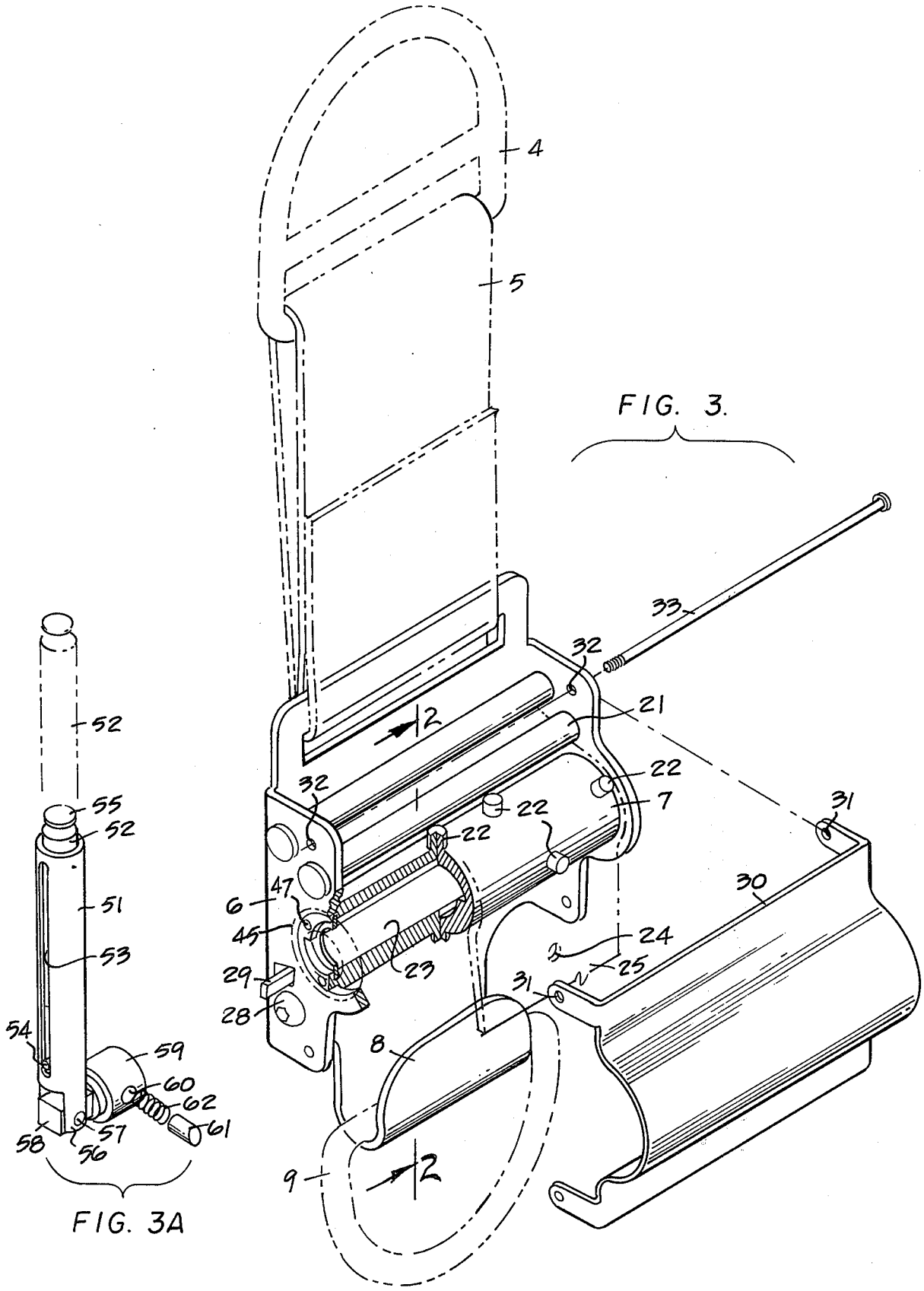
FIG. 3A is a perspective of the universal telescoping retractable wrench for use in the operation of my invention.

Referring now to the drawings and particularly first to FIG. 1, there is shown first a horse 1 and a saddle 2 which may be of any type in common use. The saddle is equipped with stirrups 3 and has positioned upon it saddle ring 4.

My strap or belt 5 has one end fixedly positioned on housing 6 and the other end passing through saddle ring 4 and returning back through housing 6 where it engages my winch mechanism as described below and then passes out through the housing and has a loose end as shown. I may also double this strap arrangement as seen on FIG. 2.

Cinch ring 9 engages strap 10 which is a conventional cinch strap which passes under the belly of the horse. Cinch ring 9 also engages the bottom end of my housing 6 through a permanent hook and spring arrangement as described more fully below.

Seen better now on FIG. 3 is my housing 6 which has positioned upon it and in rotating relation with it my winch or roller 7. A hook 8 which forms an integral part of my housing 6 is disposed to engage saddle ring 9 as described more fully below.

Referring again more particularly now to FIG. 3, my strap 6 is seen to pass under pin 21 located in housing 6 and thence to engage the teeth 22 in my roller or winch 7. The socket 23 is provided to permit engagement by a suitable wrench shown in perspective in FIG. 3A to permit rotation of drum 7 as needed and which is described more fully below.

My strap or belt 5 is equipped with holes or perforations 24 positioned along its length and disposed to engage with the teeth 22 on roller 7. After passing through teeth 22 my strap 5 hangs loosely below housing 6 as shown at 25.

The relationship between the components of my mechanism may be understood better by reference to FIG. 2 as well as FIG. 3. To maintain the roller 7 in any given position and consequently any degree of tension in belt 5 I utilize a dog or latch 27 mounted on a pin 28. This is disposed to engage the teeth 22 when in a horizontal position but may be disengaged by movement of release 29 to a lower position permitting free rotation of roller 7. My roller dog or latch 27 may be spring activated, thereby maintaining constant tension against latch release 29.

I enclosed my housing 6 with an easily removable cover plate 30, having holes 31 adapted for mating with holes 32 in my housing 6 and being held in position by a pin 33.

Figure 5:
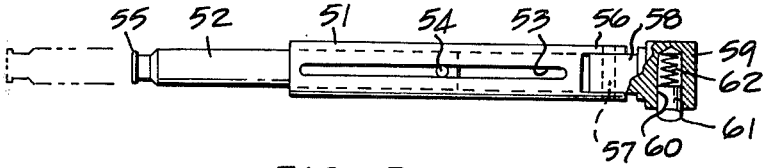
FIG. 5 is a longitudinal view partially cut-away of my universal telescoping and retractable handle showing the pawl.

Referring now to FIG. 3A and FIG. 5, there is seen my new and improved universal, telescoping, retractable wrench. There is seen first my sliding shaft 51 which carries the telescoping handle 52 and is equipped with a guide slot 53. A stop pin 54, which may be spring loaded, guides and limits the travel of handle 52 inside of shaft 51. A grip 55 on the end of handle 52 assists in sliding handle 52 in and out of shaft 51.

On the opposite end of shaft 51 there is positioned a toggle or universal type of mechanism. This comprises a yoke 56, a pin 57 and a follower 58. A cylindrical member 59 forms an integral part of follower 58 and is adapted for sliding relation with the inside 23 of my winch 7, which as set forth above is a cylindrical hollow center of winch 7 into which the complete assembly of my wrench may be slid.

Positioned inside cylindrical member 59 is a radial hole 60 adapted to receive pawl 61 and spring 62 and hold it in operation relationship with my cylindrical ratchet inside the hollow cylinder 23 of winch 7 as set forth more fully below.

Figure 4:
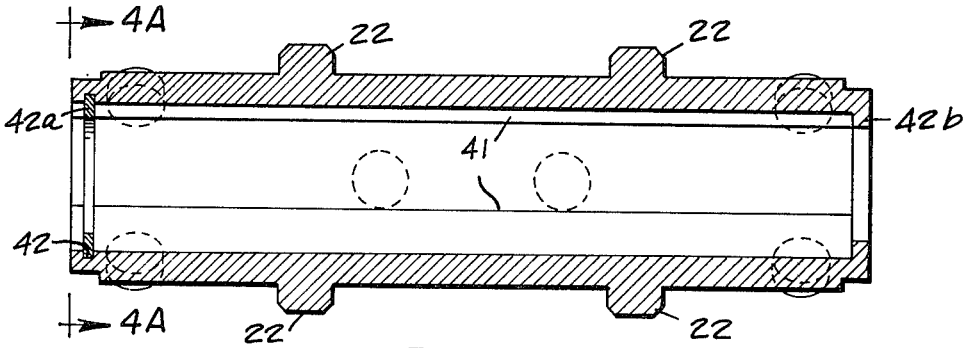
FIG. 4 is a longitudinal section through the winch of my invention.
Figure 4B:
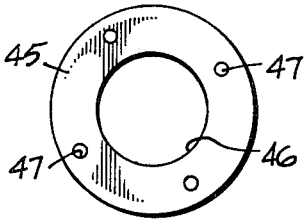
FIG. 4B is an end view of an optional hollow cover plate.
Figure 4A:
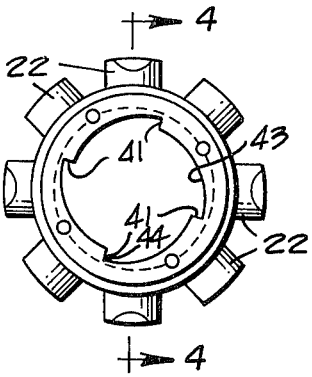
FIG. 4A is an end view of the winch with optional covers removed showing my internal ratchet.

Referring now more particularly to FIG. 4 and FIG. 4A, there is seen respectively a longitudinal section and an end view of my winch 7, having the teeth 22 described previously. On the interior cylindrical surface of my winch there is positioned and forming an integral part thereof a ratchet having teeth or stop elements 41 and a spirally curved section 44. These teeth may run the entire length of my winch as shown on FIG. 4. The relative function and operation of these elements of my invention is described below.

I my construct my winch so that one end of it has a reduced internal diameter as shown at 42B which serves as a stop and thereby limits the travel of sliding cylinder 59. On the opposite end of mmy winch I may provide a circumferential slot 42 into which I snap a ring 42A. This serves as a stop for my cylindrical member 59 in the opposite direction and may be inserted after assembly of the handle, or wrench.

Figure 4C:
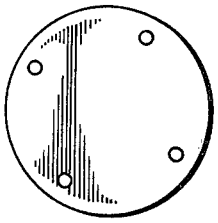
FIG. 4C is an end view of an optional solid cover plate.

As an alternative method of retaining my wrench inside the winch and limiting its travel I may employ cover plates shown on FIG. 4B and FIG. 4C. The latter is a solid plate which may be secured over one end of my winch, my wrench assembly inserted, and then the hollow plate shown on FIG. 4B attached to the winch using holes 45, 46, and 47. As thus assembled my device is ready for operation.

For simplicity of construction I may eliminate my telescoping handle 52 and utilize my shaft 51 as a handle but I have found the use of my handle 52 to be highly advantageous as will be evident from the description of the operation which follows.

OPERATION

Referring now to FIG. 3A, the operation of my device should now be evident to those skilled in the art but a brief description for purposes of clarification follows.

After the saddle 2 is place on the horse 1, I bring my device into position by engaging hook 8 with cinch ring 9 and passing my strap or belt 5 through saddle ring 4 and thence downward back into housing 6 underneath pin 21 and around roller 7 engaging holes 24 with teeth 22. At this point roller dog or latch 27 engages teeth 22 as shown. This operation is performed only once unless cinch winch is to be used on another saddle.

By means of the wrench shown on FIG. 3A, I may rotate roller 7 and as successive series of teeth 22 act on holes 24, I produce an increased tension on my strap 5 which in turn is held in any desired position of tension by the action of latch 27 on teeth 22. In the event I have produced too great a tension I am able to release it by merely depressing latch release 29 and rotating roller 7 in the opposite direction until the desired amount of tension is obtained. This feature is especially important since not only do individual horses vary a great deal in the amount of tension that is desired on belt 10, but after a period of riding, the same horse may require loosening or tightening of the strap 10 which of course may be easily effected in the manner described above while the ride is still in position in the saddle.

The operation of my novel wrench in conjunction with the foregoing should also be evident now. The normal position of my wrench is to have telescoping handle 52 slid inside of sliding shaft 51 and the whole assembly slid in axially inside the hollow cylindrical area 23 of my winch 7 so that only the grip 55 is exposed. By withdrawing the handle 52 and causing it to swivel together with shaft 51 on pin 57, I may readily effect the turning of winch 7, the teeth 22 engaging the holes in strap 5. During this period of course my pawl 61 naturally engages the ratchet teeth 41. The latter two elements, of course, remain engaged at all times that cylinder 59 is slid back and forth inside of opening 23.

When adjustment is complete the reverse steps are taken and the complete wrench assembly relocated inside of its housing, remaining free from the body of the horse or the rider.

It should be evident further how readily the rider may reach down and make adjustments to his saddle while in riding position with one hand and without the need of locating and inserting any additional tools or wrenches.

I have shown my device on the left hand side of the horse 1 but of course, it may be positioned on either side of the horse's body as desired, the same construction and principles of operation being employed.

I may fabricate my device out of any suitable materials. For example, my strap 5 may be leather but I amy also use various plastic materials if desired. My housing 6 is usually made of metal which may be stainless steel or other metals, but it likewise is adapted for manufacture out of plastics as are other component parts.

I claim:

1. In a device for use in adjusting the saddle belt on a horse, an improved winch device comprising:

a hollow rotating member of generally cylindrical configuration, the internal cylindrical surface of said member comprising a ratchet having teeth disposed about its circumference; said teeth extending axially along the entire length of said member;

a plurality of projectors positioned radially around the exterior surface of said member and disposed to engage holes in said belt;

means for positively engaging and disengaging said projectors to control the rotation of said member;

a sliding shaft positioned concentrically inside said rotating member in axially slidable relation therewith;

a pawl positioned at one end of said shaft in hinged relation therewith and disposed for engagement with said ratchet;

means for limiting the travel of said shaft in an axial direction in said rotating member;

a housing and means for positioning said rotating member within said housing;

means for engaging one end of said housing with one end of an underbelly strap on said horse;

means for engaging the opposite end of said housing with said saddle belt;

handle means for rotating said shaft while said shaft is slid axially within said rotating member;

whereby said saddle belt may be adjusted regardless of the axial position of said pawl in said rotating member.

2. The device of claim 1 in which said sliding shaft is of hollow cylindrical construction and including:

a handle positioned at the end of said shaft opposite said pawl;

said handle engaging said shaft in slidable telescopic relationship;

means for limiting the travel of said handle in an axial direction in said shaft.

3. The device of claim 1 in which said ratchet is characterized by a plurality of radially projecting teeth, each of said teeth having a root and a tip;

said roots being disposed circumferentially around a first circle concentric with said internal cylindrical surface;

said tips projecting inwardly to a second concentric circle having a diameter smaller than said first circle;

each of said tips being joined in succession to the root of the adjacent tooth by a spiral surface;

said teeth extending axially along the entire length of said ratchet;

said spiral surface being disposed to engage said pawl while said pawl is subjected to a combined motion of rotation and translation.

4. The device of claim 3 in which said sliding shaft has hingedly positioned on one end a cylindrical member;

said cylindrical member being disposed for slidably engaging the interior surface of said hollow rotating member;

a pawl positioned radially on said cylindrical member;

spring means urging said pawl against said internal surface;

whereby said pawl may be rotated to engage the teeth of said ratchet and slid axially along said ratchet while so engaging said teeth and said spiral surface.

5. A cylindrical ratcheting device for producing intermittent motion to a follower member comprising:

a stationary housing;

a hollow rotating member of generally cylindrical configuration positioned in said housing;

a plurality of teeth comprising a ratchet positioned around the inside circumference of said rotating member, said teeth extending axially along the entire length of said member;

a sliding shaft positioned concentrically inside said rotating member in axially slidable relation therewith;

a pawl positioned at one end of said shaft in hinged relation therewith and disposed for engagement with said ratchet;

means for limiting the travel of said shaft in an axial direction in said rotating member;

handle means in cooperative relation with said shaft;

means positioned on said rotating member for engaging said follower member.

6. The device of claim 5 in which said ratchet is characterized by a plurality of radially projecting teeth, each of said teeth having a root and a tip;

said roots being disposed circumferentially around a first circle concentric with said internal cylindrical surface;

said tips projecting inwardly to a second concentric circle having a diameter smaller than said first circle;

each of said tips being joined in succession to the root of the adjacent tooth by a spiral surface;

said teeth extending axially along the entire length of said ratchet;

said spiral surface being disposed to engage said pawl while said pawl is subjected to a combined motion of rotation and translation.

7. The device of claim 5 in which said sliding shaft has hingedly positioned on one end a cylindrical member;

said cylindrical member being disposed for slidable engaging the interior surface of said hollow rotating member;

a pawl positioned radially on said cylindrical member;

spring means urging said pawl against said internal surface;

whereby said pawl may be rotated to engage the teeth of said ratchet and slid axially along said ratchet while so engaging said teeth and said spiral surface.

* * * * *